US011741841B2

(12) United States Patent
Schwindt et al.

(10) Patent No.: US 11,741,841 B2
(45) Date of Patent: Aug. 29, 2023

(54) METHOD AND SYSTEM FOR UPDATING A FLIGHT PLAN

(71) Applicant: GE Aviation Systems Limited, Cheltenham (GB)

(72) Inventors: Stefan Alexander Schwindt, Cheltenham (GB); Joachim Karl Ulf Hochwarth, Caledonia, MI (US)

(73) Assignee: GE Aviation Systems Limited, Cheltenham (GB)

( * ) Notice: Subject to any disclaimer, the term of this patent is extended or adjusted under 35 U.S.C. 154(b) by 204 days.

(21) Appl. No.: 17/083,966

(22) Filed: Oct. 29, 2020

(65) Prior Publication Data

US 2022/0139233 A1 May 5, 2022

(51) Int. Cl.
*G08G 5/00* (2006.01)

(52) U.S. Cl.
CPC ..... *G08G 5/0039* (2013.01); *G08G 5/0013* (2013.01); *G08G 5/0017* (2013.01); *G08G 5/0034* (2013.01)

(58) Field of Classification Search
CPC .. G08G 5/0039; G08G 5/0013; G08G 5/0017; G08G 5/0034; G08G 5/0021; G08G 5/0047; G08G 5/0052; G08G 5/0078; G08G 5/0086; G08G 5/0091
See application file for complete search history.

(56) References Cited

U.S. PATENT DOCUMENTS

| | | | | |
|---|---|---|---|---|
| 8,918,271 | B2 | 12/2014 | Pendry et al. | |
| 9,087,450 | B2 | 7/2015 | Hedrick et al. | |
| 9,202,381 | B2 | 12/2015 | Aymeric et al. | |
| 9,361,804 | B2 | 6/2016 | Mere et al. | |
| 10,037,703 | B2 | 7/2018 | Kim et al. | |
| 10,181,267 | B2 | 1/2019 | Karunakar et al. | |
| 10,347,140 | B2 | 7/2019 | Kneuper et al. | |
| 10,460,608 | B2 | 10/2019 | Borgyos et al. | |
| 10,482,774 | B2 | 11/2019 | Bonnet et al. | |
| 10,657,826 | B2 | 5/2020 | Shorter, Jr et al. | |
| 2010/0030401 | A1 | 2/2010 | Rogers et al. | |
| 2018/0075758 | A1* | 3/2018 | Martinez | G08G 5/0052 |
| 2018/0366088 | A1 | 12/2018 | Whang et al. | |
| 2019/0362636 | A1 | 11/2019 | Chikkegowda et al. | |
| 2020/0115066 | A1 | 4/2020 | De Munck et al. | |
| 2020/0273356 | A1* | 8/2020 | Raynaud | G08G 5/0078 |
| 2020/0342058 | A1* | 10/2020 | Hein | G08G 5/0034 |
| 2020/0369384 | A1* | 11/2020 | Kelly | G08G 5/006 |

* cited by examiner

*Primary Examiner* — Shon G Foley
(74) *Attorney, Agent, or Firm* — McGarry Bair PC

(57) ABSTRACT

A method for updating, for an aircraft, a first flight plan having a first set of flight parameters, includes receiving, via an avionics device, a change to the first flight plan, determining a second set of flight parameters based on the change to the first flight plan, receiving, by the avionics device, at least one of terrain data and special use airspace (SUA) data. The method includes performing, with the avionics device, a safety validation of the second set of flight parameters, wherein the safety validation comprises: comparing the second set of flight parameters with the received at least one of terrain data and SUA data, and determining, based on the comparison, whether the second set of flight parameters presents a risk to safe flight.

19 Claims, 4 Drawing Sheets

METHOD AND SYSTEM FOR UPDATING A FLIGHT PLAN

TECHNICAL FIELD

This disclosure relates generally to automatically updating a flight plan, and more specifically to validating updates to a flight plan for safe flight.

BACKGROUND

In an effort for airspace modernization, air traffic management is being modernized to leverage emerging technologies and aircraft navigation capabilities. Aircraft can exploit high accuracy provided by Global Navigation Satellite System (GNSS) or Global Positioning System (GPS)-based navigation systems, modern Flight Management Systems (FMSs) and Flight Control Systems (FCSs). Additionally, Terrain Avoidance and Warning Systems (TAWS) such as a basic Ground Proximity Warning Systems (GPWS) are used on aircraft to decrease accidents attributed to terrain incursions, such as a controlled flight into terrain. Such systems typically include a database having terrain and obstacle information and provide a warning to pilots, (e.g., based on radio altimeter and terrain closure rates), when an aircraft is in potentially hazardous proximity to terrain, including obstacles, such as man-made structures. Increasingly, more advanced TAWS such as Enhanced Ground Proximity Warning Systems (EGPWS) are used. Typically, EGPWS relate aircraft position, (e.g., from a GPS source, which can be on board, or provided by the aircraft FMS, to an on-board database having terrain and obstacle information. A set of cautions or warnings can be generated based on the radio altimeter and relative position.

Additionally, flight plans typically include at least a planned route or flight path for a given flight of an aircraft. Flight plans are generally expected to avoid areas called Special Use Airspace (SUA). For example, in the United States, SUAs can include Restricted, Warning, Prohibited, Alert, and Military Operations Areas (MOAs). In some cases, a Notice To Airmen (NOTAM) can be filed with an aviation authority to alert aircraft pilots of potential hazards that could affect the safety of a flight. Aviation authorities typically exchange NOTAMs over Aeronautical Fixed Telecommunications Networks (AFTN). In other cases, aircraft can receive weather advisories such as Significant Meteorological Information (SIGMET) which can include information regarding significant icing, turbulence, thunderstorms, and other meteorological information related to flight safety, and/or Pilot Reports (PIREPs) which can also provide in-flight weather advisories for significant meteorological hazards that could, in some instances, present risks to safe flight.

BRIEF DESCRIPTION

An aspect of the present disclosure relates to a method for updating a first flight plan having a first set of flight parameters, for an aircraft. The method includes receiving, via an avionics device, a change to the first flight plan, the change to the first flight plan comprising a second set of flight parameters and receiving at least one of terrain data and SUA data. The method also includes performing, with the avionics device, a safety validation of the second set of flight parameters, wherein the safety validation comprises: comparing the second set of flight parameters with the received at least one of terrain data and SUA data, and determining, based on the comparison, whether the second set of flight parameters plan presents a risk to safe flight.

In another aspect, the disclosure relates to a system for an aircraft. The system comprises an avionics device adapted to verify an updated flight plan, and to perform the steps of: receiving, a change to the first flight plan, the change to the first flight plan comprising a second set of flight parameters, receiving at least one of terrain data and (SUA) data; and performing a safety validation of the second set of flight parameters, wherein the safety validation comprises: comparing the second set of flight parameters with the received at least one of terrain data and SUA data, and determining, based on the comparison, whether the second set of flight parameters plan presents a risk to safe flight.

BRIEF DESCRIPTION OF THE DRAWINGS

A full and enabling disclosure of the present description, including the best mode thereof, directed to one of ordinary skill in the art, is set forth in the specification, which refers to the appended FIGS., in which.

DETAILED DESCRIPTION

Figure 1:
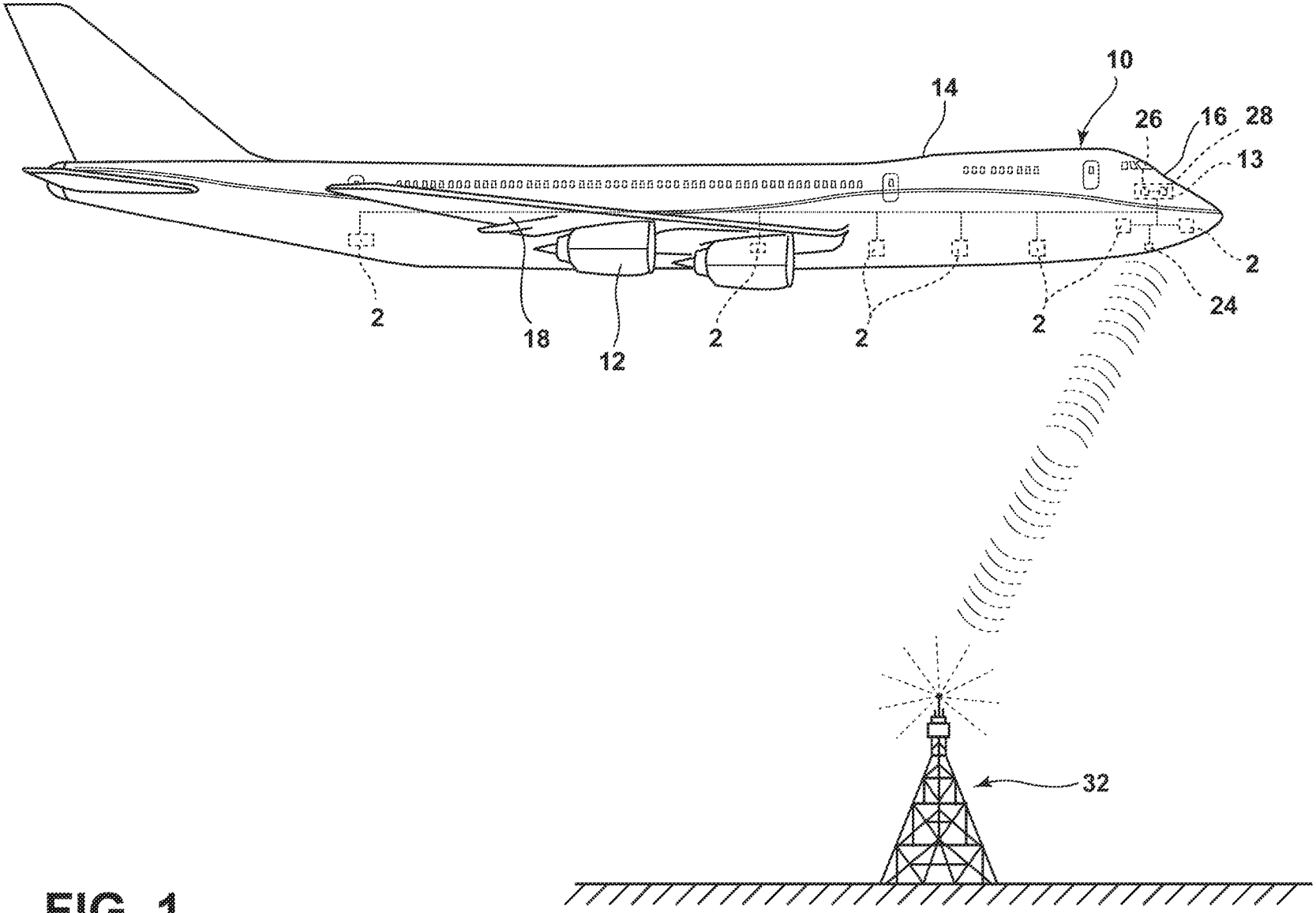
FIG. 1 is a schematic illustration of an aircraft and ground system according to aspects described herein.

Aircraft can run or be operated according to a flight plan (e.g., including a planned route, flight path, and/or airway) loaded on or through the FMS. Each flight plan can include a corresponding set of any number of flight parameters. For example, the flight parameters can include, without limitation, one or more of a flight path, a trajectory, (such as a 3-dimensional or 4-dimensional trajectory), an altitude, a flight level, an airspeed, a climb rate, a descent rate, a waypoint, a checkpoint, an airport, a turn radius, a fuel level, or any combination thereof. Typically, a flight plan will comprise the planned route plus any additional performance parameters (e.g. fuel) that are required to determine, calculate, estimate, or predict the flight parameters for that flight plan. In some cases, a portion of the flight plan can require an update or change due to environmental or operational conditions such as traffic, weather, fuel usage, or the like. It will be appreciated that updates or changes to a flight plan can comprise or result in one or more changes to the corresponding set of flight parameters. The changes to the corresponding set of flight parameters can be calculated, predicted, estimated, or otherwise determined in advance of a flight, or updated, adjusted, modified, corrected, or otherwise changed while in flight, or both. Currently, updates to flight plans received by the FMS are not automatically validated for safety relative to terrain, obstacles, SUAs, NOTAMs, SIGMETs, PIREPS, and the like.

Aspects of the present disclosure relate to providing a method and system for automatically performing a safety validation of at least a portion of a flight plan through an avionics device. In non-limiting aspects, the safety validation can be performed while the aircraft is in-flight. In some non-limiting aspects, the safety validation can also be performed pre-flight or prior to implementing updates or changes to a flight plan. In non-limiting aspects, the avionics device can comprise one or more of a FMS, or the like. For example, in aspects, an aircraft can be operating in accordance with a first flight plan having a first set of flight parameters. The avionics device can receive an update (e.g., a change or modification) to at least a portion of the first flight plan. For example, the change to at least a portion of the first flight plan can comprise a change to any one or more of the first flight parameters. The update can define a second set of flight parameters. In other aspects, the second set of flight parameters can be determined, calculated, estimated, or predicted based on the updates to the first flight plan. In aspects, the update can be received from an external source such as, but not limited to an Air Traffic Control (ATC), an Electronic Flight Bag (EFB), an Aircraft Communications Addressing and Reporting System (ACARS), an Airline Operations Center (AOC) or any combination thereof. In other aspects, the avionics device can receive the update to at least a portion the first flight plan from an on-board source such as, but not limited to a pilot, or an on-board controller, or a combination thereof. In still other aspects, the avionics device can autonomously calculate an update to the first flight plan. Regardless of the source of the update to the first flight plan, and prior to implementing the update to the first flight plan, the avionics device can generate, estimate, or otherwise determine the second set of flight parameters based on the received update to the first flight plan. The avionics device can also receive data such as terrain data or SUA data from a TAWS system, such as an EGPWS or another on board source or database. Additionally, in an aspect, the avionics device can receive NOTAM data, SIGMET data, or PIREP data, or a combination thereof, from another source and save the data to a memory. In various aspects, the terrain data, SUA data, NOTAM data, SIGMET data, and PIREP data can be received from any desired source or database without limitation.

In some non-limiting aspects, the avionics device can provide an output to a display indicative of at least one of the update to the first flight plan and the determined second set of flight parameters. For example, in non-limiting aspects, the avionics device can provide a signal to cause a display device to show or identify for the pilot or flight crew any difference between the first set of flight parameters and the second set of flight parameters. In a non-limiting example, the difference between the first set of flight parameters and the second set of flight parameters can include differences in waypoints, including added waypoints or removed waypoints or both. In another non-limiting example, the difference between the first set of flight parameters and the second set of flight parameters can include differences in flight paths. Regardless of the specific difference between the first set of flight parameters and the second set of flight parameters, in aspects, the display can include a linked list or menu of each difference between the first set of flight parameters and the second set of flight parameters. In still other aspects, the display may be a dynamic display to enable the pilot to iterate through the linked list or menu of each difference between the first set of flight parameters and the second set of flight parameters and accept or reject individual changes.

In various non-limiting aspects, the avionics device can additionally or alternatively provide an output to the display indicative of at least one of the terrain data, SUA data, NOTAM data, SIGMET data, and PIREP data. The data can be optionally be displayed adjacent or proximal to the displayed difference between the first set of flight parameters and the second set of flight parameters. For example, in a non-limiting aspect, topographical data can be displayed overlaying a display of a flight path to enable visual identifications of any obstacles that may be encountered based on the second set of flight parameters.

In other aspects, weather data can be displayed overlaying a display a way point to identify to identify if hazardous weather will be encountered at the time of passing the waypoint. In other aspects, air traffic data can be displayed overlaying a display a way point to identify to identify if air traffic will be encountered at the time of passing the waypoint.

It is contemplated that based on the display, the pilot can review the second set of flight parameters or the difference between the first set of flight parameters and the second set of flight parameters. The pilot can choose to accept the second set of flight parameters, or choose to enter a correction or change to one or more of the second set of flight parameters.

The avionics device can subsequently perform or solicit the execution of a safety validation of the second set of flight parameters for safe flight. For example, the aviation device can compare the second set of flight parameters to the received ground terrain data, no-fly zones, and the like. Based on the comparison of the second set of flight parameters to the other received data (e.g., ground terrain data), the avionics device can determine whether the set of second set of flight parameters presents a risk to safe flight. In some aspects, the avionics device can additionally perform or solicit the execution of authentications of the update to at least a portion of the first flight plan.

In the event that the safety validation determines the second set of flight parameters presents no risks to safe flight (for example, due to proximity to terrain), the avionics device can automatically update the first flight plan with the updates received in accordance with the second set of flight parameters to define, estimate, or otherwise determine a second flight plan. The aircraft can then be operated according to the updated or second flight plan. In the event that the safety of the second set of flight parameters is not validated, (e.g., due to hazardous proximity to terrain), the avionics device can generate or trigger a warning signal indicative of the risk. For example, based on the safety validation, a warning signal may be triggered to indicate the safety of the second set of flight parameters was not validated, because the second set of flight parameters presented a risk to safe flight due to an increased likelihood of a ground incursion due to potentially hazardous proximity to terrain by the aircraft when implementing the second flight plan. In some aspects, in the event that the safety of the second set of flight parameters is not validated, the avionics device can revise the received update to at least a portion the first flight plan to define a third flight plan having a third set of flight parameters, and operate the aircraft according to the third flight plan.

The received update to at least a portion of the first flight plan can be authenticated and validated for safe flight, via the avionics device, to define the second flight plan, which can subsequently be executed via the avionics device with minimal intervention required from one of either a flight crew or a pilot. This can allow for an increased safety of the aircraft by validating the update to at least a portion of the first flight plan for safe flight well in advance of warnings that would be triggered by a conventional TAWS or EGPWS, and if necessary, enable revising the updates to the first flight plan to avoid the risks altogether. The second set of flight parameters can be validated for safety and updated prior to executing the flight plan. For example, the second set of flight parameters can be updated automatically through the avionics device, or manually, prior to executing the flight plan.

As used herein, all directional references (e.g., radial, axial, upper, lower, upward, downward, left, right, lateral, front, back, top, bottom, above, below, vertical, horizontal, clockwise, counterclockwise) are only used for identification purposes to aid the reader's understanding of the disclosure, and do not create limitations, particularly as to the position, orientation, or use thereof. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to each other. In non-limiting examples, connections or disconnections can be selectively configured to provide, enable, disable, or the like, an electrical connection or communicative connection between respective elements. Furthermore, as used herein, the term "set" or a "set" of elements can be any number of elements.

As used herein, the term "safety" can refer to a condition, plan, parameter, action, or combination thereof that is unlikely to cause undesired danger, injury, loss, or damage. The danger, injury, loss, or damage can refer to such undesired outcomes to equipment or persons or both. As used herein, the term "safety validation" can refer to an action of validating, calculating, determining, assessing, estimating, confirming, proving, or the like that that a condition, plan, parameter, action, or combination thereof is unlikely to cause danger, injury, loss, or damage. As used herein, "risk to safe flight" can refer to a risk, potential, likelihood, or combination thereof of danger, injury, loss, or damage associated with flight.

As used herein, a "controller" or "controller module" can include a component configured or adapted to provide instruction, control, operation, or any form of communication for operable components to affect the operation thereof. A controller module can include any known processor, microcontroller, or logic device, including, but not limited to: Field Programmable Gate Arrays (FPGA), a Complex Programmable Logic Device (CPLD), an Application-Specific Integrated Circuit (ASIC), a Full Authority Digital Engine Control (FADEC), a Proportional Controller (P), a Proportional Integral Controller (PI), a Proportional Derivative Controller (PD), a Proportional Integral Derivative Controller (PID), a hardware-accelerated logic controller (e.g. for encoding, decoding, transcoding, etc.), the like, or a combination thereof. Non-limiting examples of a controller module can be configured or adapted to run, operate, or otherwise execute program code to effect operational or functional outcomes, including carrying out various methods, functionality, processing tasks, calculations, comparisons, sensing or measuring of values, or the like, to enable or achieve the technical operations or operations described herein. The operation or functional outcomes can be based on one or more inputs, stored data values, sensed or measured values, true or false indications, or the like. While "program code" is described, non-limiting examples of operable or executable instruction sets can include routines, programs, objects, components, data structures, algorithms, etc., that have the technical effect of performing particular tasks or implement particular abstract data types. In another non-limiting example, a controller module can also include a data storage component accessible by the processor, including memory, whether transition, volatile or non-transient, or non-volatile memory. Additional non-limiting examples of the memory can include Random Access Memory (RAM), Read-Only Memory (ROM), flash memory, or one or more different types of portable electronic memory, such as discs, DVDs, CD-ROMs, flash drives, Universal Serial Bus (USB) drives, the like, or any suitable combination of these types of memory. In one example, the program code can be stored within the memory in a machine-readable format accessible by the processor. Additionally, the memory can store various data, data types, sensed or measured data values, inputs, generated or processed data, or the like, accessible by the processor in providing instruction, control, or operation to affect a functional or operable outcome, as described herein.

The exemplary drawings are for purposes of illustration only and the dimensions, positions, order and relative sizes reflected in the drawings attached hereto can vary.

FIG. 1 is a schematic illustration of an aircraft 10 and a ground system, specifically an Air Traffic Controller (ATC) 32. The aircraft 10 can include one or more propulsion engines 12 coupled to a fuselage 14. A cockpit 16 can be positioned in the fuselage 14 and wing assemblies 18 can extend outwardly from the fuselage 14. Further, a set of aircraft systems 2 that enable proper operation of the aircraft 10 can be included as well as one or more controllers or computers 13, and a communication system having a communication link 24. While a commercial aircraft has been illustrated, it is contemplated the aircraft 10 can be any type of aircraft, for example, without limitation, fixed-wing, rotating-wing, personal aircraft, and the like.

The set of aircraft systems 2 can reside within the cockpit 16, within the electronics and equipment bay (not shown), or in other locations throughout the aircraft 10 including that they can be associated with the propulsion engines 12. Aircraft systems 2 can include but are not limited to an electrical system, an oxygen system, hydraulics or pneumatics system, a fuel system, a propulsion system, flight controls, audio/video systems, an Integrated Vehicle Health Management (IVHM) system, and systems associated with the mechanical structure of the aircraft 10.

The computer 13, can be operably coupled to the set of aircraft systems 2. The computer 13 can aid in operating the set of aircraft systems 2 and can receive information from the set of aircraft systems 2 and the communication link 24. The computer 13 can, among other things, automate the tasks of piloting and tracking the flight plan of the aircraft 10. The computer 13 can also be connected with other controllers or computers of the aircraft 10 such as, but not limited to, an avionics device 8, specifically a Flight Management System (FMS) 8.

Any number of aircraft systems 2, such as sensors or the like, can be communicatively or operably coupled to the computer 13. The sensors can provide or receive information to or from the computer 13 based on the operation of the aircraft 10.

A communication link 24 can be communicably coupled to the computer 13 or other processors of the aircraft to transfer information to and from the aircraft 10. It is contemplated that the communication link 24 can be a wireless communication link and can be any variety of communication mechanisms capable of wirelessly linking with other systems and devices and can include, but are not limited to, satellite uplink, SATCOM internet, VHF Data Link (VDL), Aircraft Communications Addressing and Reporting System (ACARS network), Aeronautical Telecommunication Network (ATN), Automatic Dependent Surveillance-Broadcast (ADS-B), WiFi, WiMax, 3G wireless signal, Code Division Multiple Access (CDMA) wireless signal, Global System for Mobile Communication (GSM), 4G wireless signal, 5G wireless signal, Long Term Evolution (LTE) signal, focused energy (e.g., focused microwave, infrared, visible, or ultraviolet energy), or any combinations thereof. It will also be understood that the particular type or mode of wireless communication is not critical, and later-developed wireless networks are certainly contemplated. Further, the communication link 24 can be communicably coupled with the computer 13 through a wired link. Although only one communication link 24 has been illustrated, it is contemplated that the aircraft 10 can have multiple communication links communicably coupled with the computer 13. Such multiple communication links can provide the aircraft 10 with the ability to transfer information to or from the aircraft 10 in a variety of ways.

As illustrated, the computer 13 can communicate with an external source. Specifically, the computer 13 can communicate with ATC 32 via the communication link 24. In aspects, ATC 32 can be a ground facility, which can communicate directly with the FMS 8 or any other avionics device communicatively coupled to the aircraft 10. In non-limiting aspects, ATC 32 can be any type of ATC 32 such as one operated by an Air Navigation Service Provider (ANSP). The computer 13 can request and receive information from the designated ATC 32 or the designated ATC 32 can send a transmission to the aircraft 10. Although illustrated as ATC 32, it will be appreciated that the aircraft 10 can communicate with any suitable external source such as, but not limited to, an Air Operations Center (AOC), or the like. In non-limiting aspects ATC 32 can provide at least one of terrain data 55, SUA data 57, NOTAM data 59, SIGMET data 54, or PIREP data 53, alone or in combination, to the computer 13.

Figure 2:
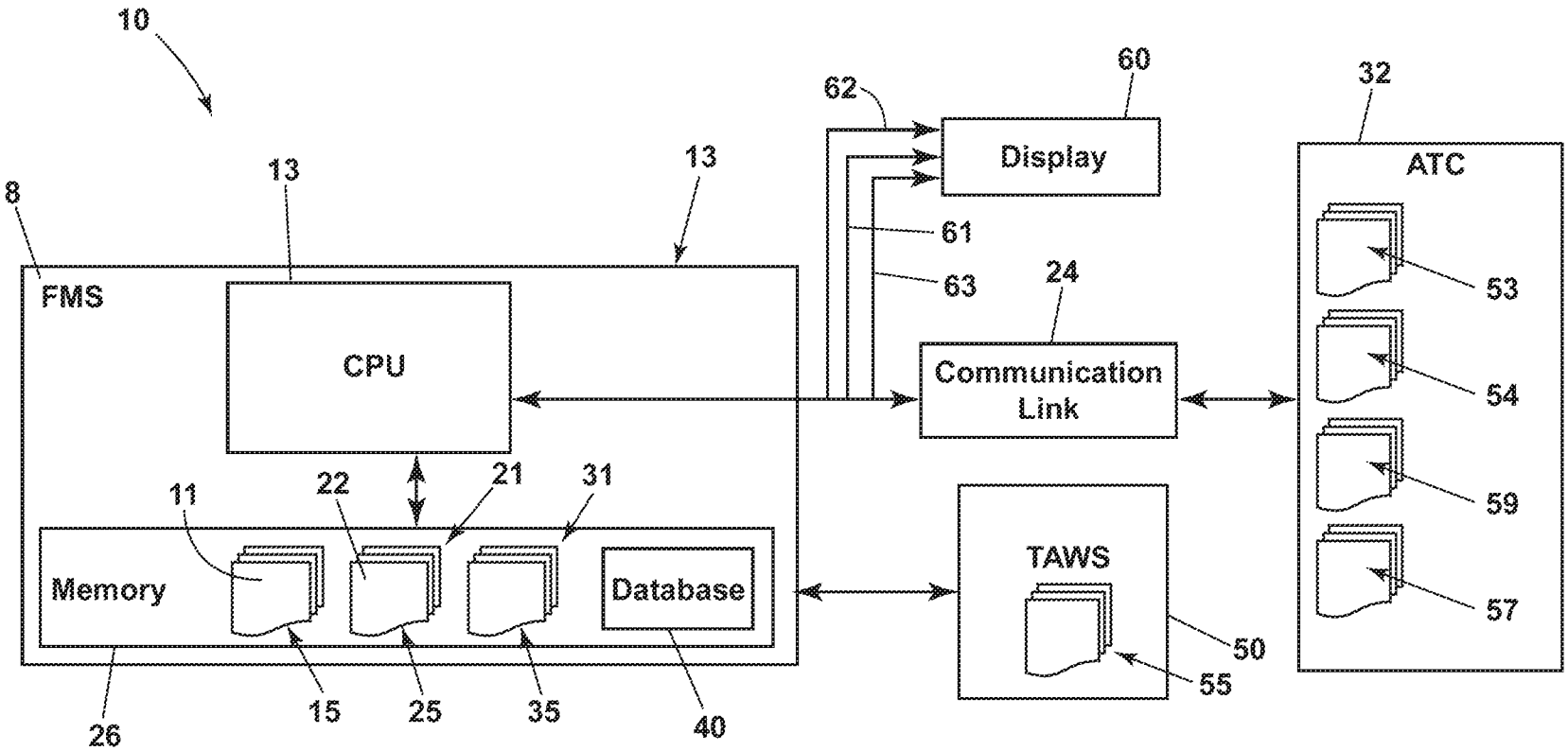
FIG. 2 is a block diagram of an avionics device that can be utilized with the aircraft and ground system of FIG. 1, according to aspects described herein.

As a non-limiting example, FIG. 2 illustrates the computer 13 that can form a portion of the FMS 8 or the FMS 8 can form a portion of the computer 13. The FMS 8 can further be communicatively coupled to ATC 32 via the communication link 24. Although illustrated as the FMS 8 and ATC 32, it will be appreciated that the FMS 8 can be any suitable avionics device as described herein and ATC 32 can be any suitable external device as described herein. The FMS 8 can be communicatively coupled to a TAWS 50, such as an EGPWS, for example to receive the terrain data 55 therefrom.

The computer 13 can be communicatively coupled to a display 60 (e.g., a monitor) and arranged to provide information in visual or auditory format, or both, to the display 60. In an aspect, the display 60 can be located in the cockpit of the aircraft 10.

The computer 13 can further include a memory 26. The memory 26 can be RAM, ROM, flash memory, or one or more different types of portable electronic memory, such as discs, DVDs, CD-ROMs, etc., or any suitable combination of these types of memory.

In the illustrated example, a database component 40 is can be included in the memory 26. It will be understood that the database component 40 can be any suitable database, including a single database having multiple sets of data, multiple discrete databases linked together, or even a simple table of data. It is contemplated that the database component 40 can incorporate a number of databases or that the database can actually be a number of separate databases. In a non-limiting aspect, the database component 40 can be a conventional Navigation Database (NDB). The database component 40 can contain information including, but not limited to, airports, runways, airways, waypoints, navigational aids, airline/company-specific routes, and procedures such as Standard Instrument Departure (SID), and Standard Terminal Approach Routes (STAR). In some aspects, the database component 40 can additionally or alternatively contain the terrain data 55 or SUA data 57, NOTAM data 59, SIGMET data 54, or PIREP data 53, alone or in combination. In various non-limiting aspects, the computer 13 can receive at least one of the terrain data 55, SUA data 57, NOTAM data 59, SIGMET data 54, or PIREP data 53, from the database component 40, memory 26, TAWS 50, ATC 30, or any combination thereof. The data, specifically the terrain data 55, SUA data 57, NOTAM data 59, SIGMET data 54, or PIREP data 53 or any combination thereof can be provided to the database component 40, memory 26, TAWS 50, or ATC 30 by any desired source or device.

The database component 40 can alternatively include the memory 26 in the FMS 8 containing a first flight plan 11 having a first set of flight parameters 15. As described in more detail herein, a modification, amendment, change, or first update 21 to at least a portion of the first flight plan 11 can comprise a second set of flight parameters 25 and can be provided to the FMS 8, and stored the memory 26.

The computer 13 can include one or more processors, which can be running or executing any suitable programs. The computer 13 can include various components (not shown) as described herein. The computer 13 can include or be associated with any suitable number of individual microprocessors, power supplies, storage devices, interface cards, auto flight systems, flight management computers, and other standard components. The computer 13 can further include or cooperate with any number of software programs (e.g., flight management programs) or instructions designed to carry out the various methods, process tasks, calculations, and control/display functions necessary for operation of the aircraft 10. By way of non-limiting example, a navigation system including a GNSS receiver configured to provide data, such as the coordinates of the aircraft 10 can be coupled with the computer 13. Position estimates provided by the GNSS receiver can be replaced or augmented to enhance accuracy and stability by inputs from other sensors, such as inertial systems, camera and optical sensors, and Radio Frequency (RF) systems (none of which are shown for the sake of clarity). Such navigational data may be utilized by the FMS 8 for various functions, such as to navigate to a target position.

While not illustrated, it will be understood that any number of sensors or other systems can also be communicatively or operably coupled to the computer 13 to provide information thereto or receive information therefrom. By way of non-limiting example, a navigation system including the GNSS receiver configured to provide data that is typical of GPS systems, such as the coordinates of the aircraft 10, can be coupled with the computer 13. Position estimates provided by the GNSS receiver can be replaced or augmented to enhance accuracy and stability by inputs from other sensors, such as inertial systems, camera and optical sensors, and Radio Frequency (RF) systems (none of which are shown for the sake of clarity). Such navigation data may be utilized by the FMS 8 for various functions, such as to navigate to a target position.

Flight plan information, such as the first flight plan 11 having the first set of flight parameters 15, and a first update 21 to any portion of the first flight plan 11 comprising a second set of flight parameters 25, and other flight procedure information can be supplied to the aircraft 10 via the communication link 24 from ATC 32 or any other suitable external source. Additionally, or alternatively, the as the first flight plan 11 having the first set of flight parameters 15, and a first update 21 to any portion of the first flight plan 11 comprising a second set of flight parameters 25 can be supplied to the avionics device via an Electronic Flight Bag (EFB). The EFB (not shown) can be communicatively coupled to ATC 32 and the communication link 24 (for example, via an Aircraft Interface Device (AID), such that the original or first flight plan 11, or any first update 21 to at least a portion of the first flight plan 11, can be received by or contained within the EFB. The EFB can then subsequently upload the first flight plan 11 or the first update 21 to the first flight plan 11 to the FMS 8 via the communication link 24. The EFB can include a controller module, which can be configured to automatically perform the calculations, determinations, and executions, of the FMS 8. The controller module can be configured to run any suitable programs or executable instructions designed to carry out various methods, functionality, processing tasks, calculations, or the like, to enable or achieve the technical operations or operations described herein. As such, it will be understood that the various operations described herein of updating the first flight plan 11 can be done through or via the avionics device, specifically the FMS 8. As used herein, the phrase "via the avionics device" can be defined as processing or other suitable operations done within the avionics device through the components of the avionics device, or the phrase can alternatively refer to the processing and other suitable operations done external to the avionics device in which the avionics device delegated or solicited the external device to perform these operations. The external device can include, for example, the EFB.

During flight, the current or first flight plan for the aircraft can be executed under the direction of the FMS (either Flight Director indications to pilot or Autopilot command). It will be understood that aircraft in flight often update or make changes to their current flight plan. The changes or updates can result in or necessitate changes to any number of flight parameters (e.g., vertical and horizontal trajectories). The updates to the flight plan can be manually entered. For example, the updates to the flight plan can be manually entered (e.g., by a pilot on a Multi-Function Control Display Unit (MCDU) or Multi-purpose Control Display of the FMS. Alternatively, or additionally, the updates to the flight plan can be provided by an external source to the FMS. For example, in various aspects, the external source can be, without limitation, an ATC, AOC, ACARS, EFB, etc. Regardless of the source of the update, it will be further understood that such updates to a flight plan may contain errors when generated or implemented, including errors that could lead an aircraft in flight to enter an undesired or unsafe location (e.g., too close to terrain). Such errors can have any number of sources, such as but not limited to human error (e.g., keying errors), FMS software errors, programming errors, database errors, errors of nefarious intent (e.g., sabotage), or any combination thereof.

Regardless of the source of the error, when an aircraft in flight enters or approaches an unsafe location, conventional systems such as EGPWS are configured to issue a warning or an alert to the pilot of the aircraft to initiate appropriate corrective actions (e.g. "Terrain—Pull Up!"). However, this conventional warning system has safety implications (e.g., reduction of safety margin), operational implications (e.g., flight diversion) and regulatory implications (e.g., mandatory reporting and associated investigation). Aspects as described herein can compare the updated flight plan or updates to the current flight plan to terrain and SUA data, in other words, simulate the updated flight plan to identify or determine whether any of the changes or updates to the current flight plan presents a risk to safe flight. In this way aspects as described herein can thereby identifying safety issues in advance, and avoiding such undesired situations altogether.

Aspects as described herein provide an avionics device (e.g., an FMS) to receive a flight plan, or updates to a flight plan, whether manually entered into the FMS (e.g., by a pilot) or provided by external source (e.g. ACARS, EFB), validate the flight plan or changes to the flight plan to determine whether the flight plan, or updates to a flight plan present a risk to safe flight. For example, in aspects, the determination whether any of the changes or updates to the current flight plan presents a risk to safe flight can include comparing the flight parameters (e.g., vertical and horizontal trajectories) of the flight plan, or updates to the flight plan, to terrain data. The terrain data can be stored in a memory of the FMS or received from an external source (e.g., without limitation, TAWS, ATC, AOC, EFB). In other aspects, the FMS can provide the flight plan, or updates to a flight plan, to another avionics device or system such as the TAWS or EFB to simulate the modified flight plan as it would be executed under the direction of the FMS (for example, by Flight Director indications to pilot or Autopilot command). If the FMS, TAWS, EFB or other avionics device identifies or determines any risk to safe flight, (e.g. terrain proximity), then a warning signal can be generated that can notify the pilot or trigger the FMS to implement a predetermined response such as rejecting the updates to the flight plan, or generating an indication of the warnings or alerts to initiate corrective action by the pilot. Additionally, or alternatively, based on the identified or determined risk to safe flight, the avionics device can revise the received update to at least a portion of the first flight plan to define a third flight plan having a third set of flight parameters, and operate the aircraft according to the third flight plan. In some aspects, the warning signal can include details of the third flight plan.

For example, if the determination is that the flight plan, or updates to the flight plan do not present a risk to safe flight, aspects can determine or calculate a modified or updated flight plan based on the received updates, and implement the determined or calculated flight plan. On the other hand, if the determination is that the flight plan, or updates to the flight plan do present a risk to safe flight, aspects can generate a warning (e.g., for pilot review), provide data to the FMS for correction of the flight parameters, calculate new flight parameters (e.g., a new trajectory) to avoid the determined risk, validate the new parameters (e.g. confirm sufficient fuel available for flight and landing, minimum reserves, flight duration not extended by a predetermined time, etc.), create a log entry for post-flight analysis, or a combination thereof.

In aspects the warning signal (e.g. a display message) can provide indication to pilot or flight crew of the determination of the risk to safe flight. In some aspects, the warning signal can include details or data associated with the risk or flight parameters or both to allow correction of the flight plan, or updates to the flight plan to avoid or eliminate the risk to safe flight.

It is contemplated that various aspects as described herein can support trajectory-based operations (TBO) for an aircraft. In non-limiting aspects, the first set of flight parameters 15 can include trajectory-based parameters. For example, in some aspects, the trajectory-based parameters of the first set of flight parameters 15 can include a first 3-dimensional trajectory (3DT), e.g., lateral (latitude and longitude) and vertical (altitude). Accordingly, the first 3DT can include a series of points from departure to arrival representing the aircraft's path in three dimensions. In other non-limiting aspects, the trajectory-based parameters of the first set of flight parameters 15 can include a first 4-dimensional trajectory (4DT), e.g., lateral (latitude and longitude), vertical (altitude), and time. Accordingly, the first 4DT can include a series of points from departure to arrival representing the aircraft's path in four dimensions and time.

Figure 3:
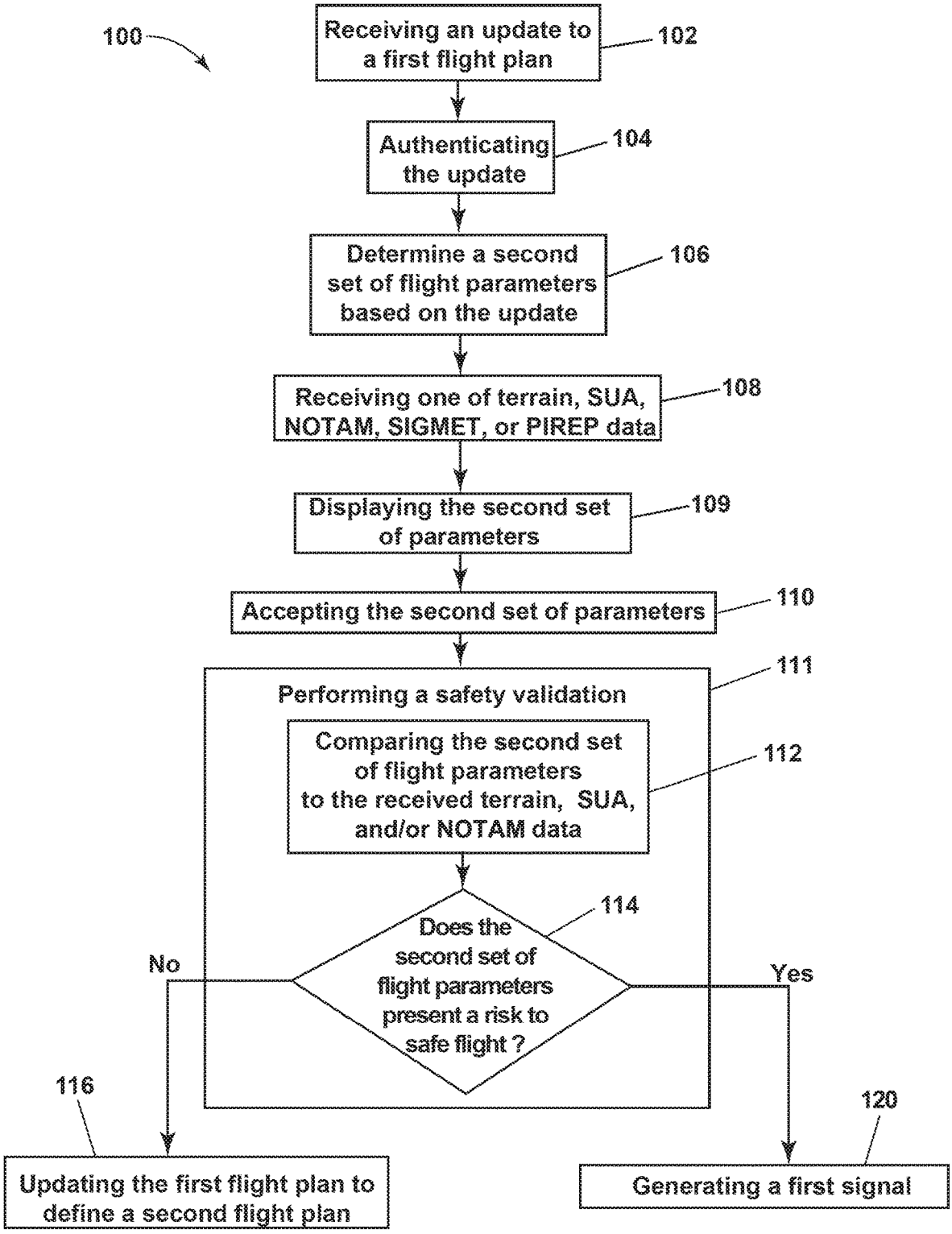
FIG. 3 is a flow chart diagram illustrating a method of updating a flight plan through the avionics device of FIG. 2 including a safety validation, according to aspects described herein.

FIG. 3 illustrates a non-limiting example of a method 100 of updating the first flight plan 11 for an aircraft 10, the flight plan 11 having the first set of flight parameters 15 received from ATC 32 via the FMS 8 of FIG. 2. The method 100 can be performed while the aircraft 10 is in-flight (i.e., executing the flight plan 11), or pre-flight (i.e., prior to executing the flight plan). The first set of flight parameters 15 can include any one or more of, but is not limited to, one or more of a first flight path, a first trajectory, a first 3DT, a first 4DT, a first airway, a first altitude, a first flight level, a first airspeed, a first climb rate, a first descent rate, a first waypoint, a first checkpoint, a first airport, a first turn radius, or any combination thereof. Although described in terms of the FMS 8 and ATC 32, it will be appreciated that the method 100 can be applied to any suitable avionics device configured to communicate with any suitable external device.

The method 100 can begin with the FMS 8 receiving a first update 21 to at least a portion of the first flight plan 11. For example, the first update 21 can be manually entered into the FMS (e.g., by a pilot) or provided by external source (e.g. ACARS, EFB, ATC, etc.), at 102. In various non-limiting aspects, the first update 21 can be received pre-flight, during flight, during predetermined portions of a flight, periodically during flight, or triggered an event, or as otherwise determined necessary (e.g., by the pilot or ATC). For example, a first update 21 can be provided to the FMS 8 periodically or based on triggers (e.g. a threshold when a first flight parameter is predicted or determined to be inaccurate or otherwise undesirable due to an updated forecast and changed atmospheric condition). In aspects, the first update 21 to the first flight plan 11 can include the second set of flight parameters 25. In other aspects, the second set of flight parameters 25 can be calculated, predicted, estimated, or otherwise determined based on the first update 21 by the FMS 8. The second set of flight parameters 25 can include any one or more of, but is not limited to, a change, difference, modification, or update to any one or more of the first set of flight parameters 15. For example, the second set of flight parameters 25 can include any one or more of, but is not limited to, data defining one or more of a second flight path, a second trajectory, a second 3DT, a second 4DT, a second airway, a second altitude, a second flight level, a second airspeed, a second climb rate, a second descent rate, a second waypoint, a second checkpoint, a second airport, a second turn radius, or any combination thereof. For example, it is contemplated that the first update 21 to the first flight plan 11 can include a change of a first altitude the aircraft 10 or a change in one or more waypoints of the first flight path.

The first update 21 to at least a portion of the first flight plan 11 can also be authenticated or validated, for example via the FMS 8, at 104. This can be done automatically by the FMS 8. As used herein, a valid update can be defined as the first update 21 to at least a portion of the first flight plan 11 that was validated or authenticated, via the FMS 8. The validation or authentication of the modification or first update 21 to the first flight plan 11 can include verifying the source of the first update 21 to at least a portion of the first flight plan 11.

The validating and authenticating of the first update 21 to the first flight plan 11 can include verifying that the data contained within the first update 21 to the flight plan has a reasonable or correct range or field. In other words, the validating can comprise determining a correctness of data fields and ranges of the first update 21 to at least a portion the first flight plan 11. For example, if the first update 21 to at least a portion of the first flight plan 11 contains a change to the location of the destination airport including at least a latitude, longitude and elevation, the values of the update to the location of the airport can be validated or authenticated, via the FMS 8, to ensure an updated location of the airport makes sense when compared a previous known location of the airport. For example, if the first update 21 to at least a portion of the first flight plan 11 includes an elevation of the destination airport that is indicated to be a predetermined amount different (e.g., 100% greater) than the previously known elevation, the data field and ranges of the first update 21 can be flagged, via the FMS 8, as not being correct as it does not make sense for an airport to gain such a large elevation change.

Based on the received first update 21, the FMS 8 can calculate, predict, estimate, or otherwise determine the second set of flight parameters 25, at 106. For example, the FMS 8 can calculate a new trajectory (i.e. the exact path including altitudes between waypoints) based on the first update 21. This calculated trajectory can then be compared against the terrain data or data of restricted areas. For example, in another non-limiting aspect, based on the received first update 21, the FMS 8 can calculate, predict, estimate, or otherwise determine the second set of flight parameters 25, at 106 by calculating or predicting a second 4DT based on the first update 21. This predicted second 4DT can then be compared against the terrain data or data of restricted areas.

The FMS 8 can receive at least the terrain data 55, SUA data 57, NOTAM data 59, SIGMET data 54, PIREP data 53 or a combination thereof from ATC 32, at 108. In other aspects, the FMS 8 can receive the terrain data 55 from the TAWS 50. In still other aspects, the FMS 8 can receive the terrain data 55, SUA data 57, NOTAM data 59, SIGMET data 54, and PIREP data 53 from any other desired source. The terrain data 55 can include one or more of, but are not limited to, data associated with a terrain feature, an obstacle, a wind shear, a weather pattern, or a combination thereof. In non-limiting aspects, the SUA data 57 can comprise, without limitation, data associated with airspace designated for a special use such as areas classified as Restricted, Warning, Prohibited, Alert, and Military Operations Areas (MOAs). In aspects, the PIREP data 53 can include, without limitation, data associated with a hazardous weather condition. In aspects, the SIGMET data 54 can include, without limitation, data associated icing or turbulence or a combination thereof.

In some non-limiting aspects, the FMS 8 can provide an output signal 63 to the display 60 indicative of the second set of flight parameters 25. For example, in an aspect, the output signal 63 can cause the display 60 to display least one of the first update 21 and the determined second set of flight parameters 25. In non-limiting aspects, the display 60 can indicate a difference between the first set of flight parameters 15 and the second set of flight parameters 25. For example, the difference between the first set of flight parameters 15 and the second set of flight parameters 25 can include a difference in a waypoint, such as an added waypoint or a removed waypoint, or both. In another non-limiting example, the difference between the first set of flight parameters 15 and the second set of flight parameters 25 can include a difference between flight paths. In aspects, the display 60 can include a linked list or menu of each determined difference between the first set of flight parameters 15 and the second set of flight parameters 25. In some aspects, the pilot can review and accept or reject specific parameters of the second set of parameters 25.

In various non-limiting aspects, the FMS 8 can additionally or alternatively provide the output signal 63 to the display 60 indicative of at least one of the terrain data, SUA data, NOTAM data, SIGMET data, and PIREP data, to cause the terrain data, SUA data, NOTAM data, SIGMET data, and PIREP data to be displayed, at 108. For example, the at least one of the terrain data, SUA data, NOTAM data, SIGMET data, and PIREP data can be displayed in conjunction with and adjacent or proximal to a determined difference between the first set of flight parameters 15 and the second set of flight parameters 25. For example, in an aspect, terrain data can be displayed overlaying a display a flight path. In other aspects, hazardous weather data can be displayed overlaying a way point. In other aspects, air traffic data can be displayed overlaying a way point.

It is contemplated that based on the displayed data on display 60, the pilot can review the second set of flight parameters 25 or the difference between the first set of flight parameters 15 and the second set of flight parameters 25. The pilot can choose to accept the second set of flight parameters 25, or choose to manually modify or enter a change to one or more parameter 25 of the second set of flight parameters 25, at 110.

In an aspect, at 111, a safety validation can be performed by comparing the second set of flight parameters 25 against the terrain data 55, SUA data 57, NOTAM data 59, SIGMET data 54, PIREP data 53 or a combination thereof, at 112. For example, in non-limiting aspects, the safety validation can be performed by comparing the second set of flight parameters 25 against the terrain data 55, SUA data 57, NOTAM data 59, SIGMET data 54, PIREP data 53 or a combination thereof via the FMS 8. In other non-limiting aspects, the FMS 8 can alternatively provide the second set of flight parameters 25, or the terrain data 55 or SUA data 57, or both, to the EFB and the safety validation can be performed by comparing the second set of flight parameters against the terrain data 55, SUA data 57, or both, via the EFB. In still other aspects, the FMS 8 can provide the second set of flight parameters 25 to the EFB, and the terrain data 55, SUA data 57 NOTAM data 59, SIGMET data 54, PIREP data 53 or a combination thereof can be provided to the EFB by ATC 32, the TAWS 50, or any other desired source to perform the safety validation. It is contemplated that the comparing the second set of flight parameters 25 against the terrain data 55, SUA data 57, NOTAM data 59, SIGMET data 54, PIREP data 53 or a combination thereof is not limited to a specific computer or controller, and in various aspects, can be done using any desired computer or controller communicatively coupled to FMS 8 without departing from the scope of the disclosure.

The comparing can be done to determine, at 114 if at least one flight parameter of the second set of flight parameters 25 will result in an unsafe flight condition for the aircraft 10 (e.g. the aircraft 10 will be in potentially hazardous proximity to terrain if the second set of flight parameters 25 are implemented or followed) thereby presenting a risk to safe flight of aircraft 10. In non-limiting aspects, the comparing at 114 can additionally or alternatively be done to determine if at least one flight parameter of the second set of flight parameters 25 will result in an undesired flightpath or entry into a SUA thereby presenting a risk to safe flight of aircraft 10. For example, the second set of flight parameters 25 can define a second flight path and a second altitude that can be compared (e.g., via the FMS 8 or EFB) to the terrain data 55, SUA data 57 NOTAM data 59, SIGMET data 54, PIREP data 53 or a combination thereof, along the second flight path. The safety validation can confirm or validate the safety (or lack thereof) of the second set of flight parameters.

For example, in an aspect, the safety validation at 111 can determine, based on the comparison of the received second set of flight parameters 25 to the received terrain data 59, at 112, that operating the aircraft in accordance with a flight plan based on the second set of flight parameters 25 would result in a risk to safe flight. In such an event or determination, the second set of flight parameters 25 can be considered to present a risk to safe flight by the aircraft 10. In an aspect, the safety validation at 111 can also determine, based on the comparison between the received second set of flight parameters 25 and the terrain data 55, SUA data 57 NOTAM data 59, SIGMET data 54, PIREP data 53 or combination thereof, that operating the aircraft in accordance with a flight plan based on the second set of flight parameters 25 would not result in a potentially hazardous proximity to terrain, or entry into a SUA, or other hazardous area, by the aircraft 10. In such an event or determination, the second set of flight parameters 25 can be considered to not present a risk to safe flight by the aircraft 10 (i.e., result in a safe update to the first flight plan 11). While in various aspects, the safety validation at 111 can be performed by the FMS 8, it is contemplated that the safety validation at 111 can additionally or alternatively be performed by various avionics devices external to the FMS 8. For example, in a non-limiting aspect, the safety validation can be performed by the EFB. In another non-limiting aspect, the safety validation can be performed by any other desired avionics device.

At 114, if the second set of flight parameters 25 is determined to be safe, that is, to not present a risk to safe flight, then the first flight plan 11 can be automatically updated according to the received first update 21 to define a second flight plan 22 at 120. As used herein, the term "automatically" can be defined by a process done without the need for interaction or direct input from a user of the aircraft 10. For example, the first flight plan 11 can be updated automatically to define the second flight plan 22, via the FMS 8, without interaction from a user of the aircraft 10. As such, the aircraft 10 can then be operated according to the second flight plan 22. It will be understood when a modification or first update 21 to a first flight plan 11 loaded into or provided to the FMS 8, it would typically preferably be reviewed by the pilot or flight crew of the aircraft 10. However, in some situations, such a manual review of the first update 21 may not be possible or timely (e.g. an emergency diversion). Aspects as described herein enable an automatic review or safety validation by configuring the FMS 8 to cooperate with an external device (e.g. TAWS 50) to perform the safety validation prior to implementing the first update 21.

On the other hand, if the safety validation at 111 finds, indicates, or determines that operating the aircraft in accordance with an updated flight plan based on the first update 21 to at least a portion of the first flight plan 11 would result in a potentially hazardous or unsafe proximity to terrain, or undesired entry into a SUA, or other hazardous area, by the aircraft 10 (i.e., to present a risk to safe flight by the aircraft 10), a first signal 51, such as a warning signal indicative of the determined risk to safe flight, can be generated, at 118. For example, in the event the safety validation at 111 finds, indicates, or determines operating the aircraft in accordance with a flight plan based on the second set of flight parameters 25, if implemented, would result in a potentially hazardous proximity to terrain by the aircraft 10, a first signal 51 indicative of the risk to safe flight can be generated via the FMS 8. The first signal 61 (e.g. a warning signal) could be any one or more of an indication sent to the display 60 within the cockpit of aircraft 10 that is visible to one or more of the flight crew or the pilot indicating that operating the aircraft in accordance with a flight plan based on the second set of flight parameters 25 presents a risk to safe flight. For example, the first signal 51 could be sent to a user interface of the EFB or the computer 13. In an aspect, the first signal 51 can also include an auditory alarm.

Figure 4:
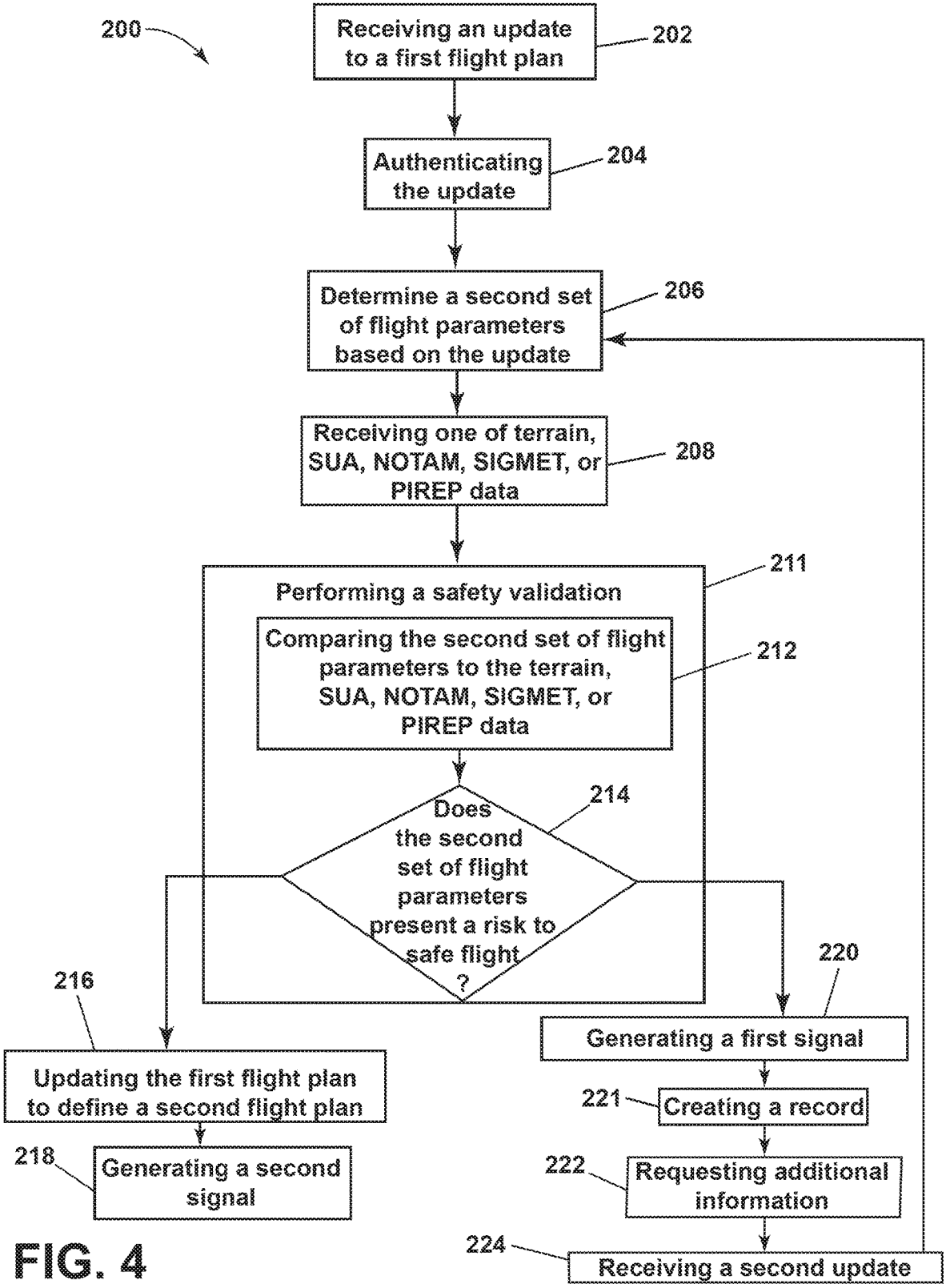
FIG. 4 is a flow chart diagram illustrating a method of updating a flight plan through the avionics device of FIG. 2 including a first update and a second update, according to aspects described herein.

FIG. 4 illustrates a non-limiting example of a method 200 of updating the first flight plan 11 for an aircraft 10, the flight plan 11 having the first set of flight parameters 15 received from ATC 32 via the FMS 8 of FIG. 2. The method 200 can be performed while the aircraft 10 is in-flight (i.e., executing the flight plan 11), or pre-flight (e.g., prior to executing the flight plan). Although described in terms of the FMS 8 and ATC 32, it will be appreciated that the method 200 can be applied to any suitable avionics device configured to communicate with any suitable external device.

The method 200 can begin with the FMS 8 receiving the first update 21 to at least a portion of the first flight plan 11 from ATC 32, at 202. The first update 21 to at least a portion of the first flight plan 11 can then optionally be authenticated or validated, via the FMS 8, at 204. The validation or authentication of the first update 21 can include verifying the source of the first update 21 to the first flight plan 11. With the first update 21 received, the second set of flight parameters 25 can be determined, via the FMS 8, at 206. For example, in non-limiting aspects, the FMS 8 can determine the second set of flight parameters by calculating a new trajectory (i.e. the exact path including altitudes between waypoints) based on the first update 21 to the first flight plan 11. The calculated new trajectory can then be compared against the terrain data 55, SUA data 57, NOTAM data 59, SIGMET data 54, PIREP data 53 or combination thereof. In an aspect, the FMS 8 can further receive at least the terrain data 55 or SUA data 57, NOTAM data 59, SIGMET data 54, PIREP data 53 or combination thereof from ATC 32, at 208. In other aspects, the FMS 8 can receive the terrain data 55 from the TAWS 50. In still other aspects, the FMS 8 can receive the terrain data 55, the SUA data 57, NOTAM data 59, SIGMET data 54, or PIREP data 53 or from any other desired source. The safety validation can then be performed, via the FMS 8, at 211. For example, the second set of flight parameters 25 can then be compared with the terrain data 55, SUA data 57, NOTAM data 59, SIGMET data 54, PIREP data 53 or combination thereof, via the FMS 8, at 212.

At 214, if the second set of flight parameters 25 is determined to be safe, that is, to not present a risk to safe flight, then the first flight plan 11 can be automatically updated according to the received update 21 to define the second flight plan 22 at 216. As such, the aircraft 10 can then be operated according to the second flight plan 22.

Additionally, a second signal 62, such as an indication or safety validation indication, can further be generated, via the FMS 8, and provided to the display 60 in order to indicate to one or more of the flight crew, the pilot, or ATC 32 that the first flight plan 11 has been updated to define the second flight plan 22, at 218. In aspects, the second signal 62 can provide an expression that the first update 21 to at least a portion of the first flight plan 11 was validated for safety, i.e., does not present a risk to safe flight, or the first flight plan 11 has been updated to define the second flight plan 22, or a combination thereof. The second signal 62 can be provided on one or more of a user interfaces of the FMS 8, the EFB, the computer 13, ATC 32, or any other suitable device. It is contemplated that the second signal 62 can further include a detailed message containing at least a portion of the updates made to the first flight plan 11. For example, the second signal 62 can optionally include one or more of an updated flight time, an updated destination time, an updated flight usage, or any combination thereof.

In the event the second set of flight parameters 25 are determined at 211 to present a risk to safe flight, then the first signal 61 (i.e., the warning signal) can be generated, via the FMS 8, at 220. In a non-limiting aspect, the first signal 61 can include information related to specific flight parameters of the second set of flight parameters 25, or a reason why the second set of flight parameters 25 were determined to present a risk to safe flight, or a combination thereof. For example, it is contemplated the first signal 61 can include a detailed message containing at least a portion of the second set of flight parameters 25 that were determined to present a risk to safe flight. In aspects, the first signal 61 can trigger the FMS 8 to reject or otherwise not implement the first update 21.

Additionally, or alternatively, the methods 100, 200 can include generating, via the avionics device, one or more summaries to be included in the first signal 61 or second signal 62. For example, once the safety validation of the of the update is determined, the FMS 8, or any other suitable avionics device (e.g., the EFB), can automatically perform a review or analysis of the safety validation of the update to at least a portion of the first flight plan 11. Certain sections of the update to at least a portion of the first flight plan 11 can be highlighted or otherwise flagged, via the avionics device. These sections, which are flagged, via the avionics device, can include, for example, one or more portions of the updated or current flight parameters, the comparison between the updated and current flight parameters or environmental conditions, the environmental conditions, the update to the flight plan itself, or any combination thereof.

In the case of a determination of a risk to safe flight, the review or analysis can determine the reasons for why the update to at least a portion of the first flight plan 11 was determined to present a risk or otherwise flag these sections. The highlighted or otherwise flagged sections can then be compiled into the summary and sent to one or more of the flight crew, the pilot, any suitable external source, or any combination thereof through the first signal 61 or the second signal 62. The flight crew, the pilot, any suitable external source, or any combination thereof can then review the summary in order to easily identify the changes that were made in the case of the first signal 61.

For example, in non-limiting aspects, the first signal 61 can additionally or alternatively trigger creation of a record, summary, log entry, or the like, of predetermined details or data fields associated with the first update 21, at 221. The created record or summary can then be used for a post-flight analysis. For example, in an aspect, the first signal 61 can trigger the FMS 8 to save to memory (e.g., to a log file), a copy of the first flight plan 11, the first update 21, and any other predetermined details associated with the determination that operating the aircraft in accordance with an updated flight plan based on the first update 21 would present a risk to safe flight. In other aspects, the FMS 8 can trigger the operation of an error report module to automatically create a report, without requiring pilot intervention. In other non-limiting aspects, the creating a record at 221 can include saving the record into the aircraft Flight Data Recorder. It is contemplated that the FMS 8, or the error report module, or both can further designate the error report or a portion of the error report be protected, and not be overwritten. In other aspects, the FMS 8 can additionally or alternatively provide the error report, a copy of the first flight plan 11, the first update 21, and any other predetermined details associated with the determination that operating the aircraft in accordance with an updated flight plan based on the first update 21 would present a risk to safe flight to the AOC, and can further designate the error report or a portion of the error report be protected, and not be overwritten.

Further in response to the first signal 61, in non-limiting aspects, a request can be generated, via the FMS 8, for additional information via a second update 33, at 222. For example, the request for additional information at 222 can comprise a request for a third set of flight parameters 35. In some aspects, the requesting additional information can include identifying at least one safety issue based on second set of flight parameters. The request for additional information can be in the form of a message provide to the communication link 24 or the display 60 or a combination thereof. In non-limiting aspects, the additional information requested at 222 can be any set of corrected or updated flight parameters such as any one or more of, but not limited to, one or more of a third flight path, a third airway, a third trajectory, a third DT, a third 4DT, a third altitude, a third flight level, a third airspeed, a third climb rate, a third descent rate, a third waypoint, a third checkpoint, a third airport, a third turn radius, or any combination thereof. In a non-limiting aspect, the additional information can be requested and received, via the FMS 8, from the external source, specifically ATC 32, without the need for manual intervention from the flight crew or the pilot. In other aspects the request for additional information can be generated by the pilot in response to the first signal 61. In other aspects the FMS 8 transmit the request to ATC 32, the pilot, or other avionics device, or a combination thereof for an update to second set of flight parameters 25. The pilot, ATC 32, or other avionics device can subsequently transmit, send, enter, or otherwise provide the requested additional information (i.e., an update to the second set of flight parameters 25 to the aircraft 10, which can be received via the FMS 8). The additional information can comprise or be contained within the second update 33 to the first flight plan 11.

It is further contemplated that the flight crew or the pilot can receive and review the first signal 61 and determine the specific second flight parameters that need to be changed to ensure the first update 21 to at least a portion of the first flight plan 11 does not present a risk to safe flight. As such, the second update 33 can be received, via the FMS 8, at 224. At least a portion of the method 200, specifically 206 through 211, can then be repeated or performed again using the set of third set of flight parameters 35 of the second update 33 at 202. In an aspect, the third set of flight parameters 35 of the second update 33 can be combined with the first update 21 to at least a portion of the first flight plan 11. In the event the second update 33 to the first flight plan 11 is determined to not to present a risk to safe flight, the first flight plan 11 can be automatically updated according to the second update 33 to define the second flight plan 22, via the FMS 8, at 216. Alternatively, if the second update 33 is found to be once again present a risk to safe flight, the first signal 61 can be generated, via the FMS 8, at 220. In an aspect, the first signal 61 can contain information that indicates to one or more of the flight crew or the pilot the portions (i.e., specific flight parameters of the third set of flight parameters 35, such as a third altitude or a third flight path, or both) that are deemed to present a risk to safe flight. As a result, the first signal 61 can identify or highlight third flight parameters of the third set of flight parameters 35 for review by the flight crew or the pilot. As such, the flight crew, the pilot, ATC 32, the EFB, or any suitable external device can supply any number of additional updates to at least a portion of the first flight plan 11 until the updated flight plan is determined to not present a risk to safe flight, and the first flight plan 11 can be automatically updated.

In another non-limiting example, the first signal 61 generated, at 220, or the second signal generated, at 216, can each include a summary of the relevant information to the safety validation, respectively, of the update to at least a portion of the flight plan. Specifically, in the case of the second signal 62, the summary can include at least one update made to the flight plan. On the other hand, in the case of first signal 61, the summary can include the one or more sections of the update to the flight plan that were determined to present a risk to safe flight.

The sequences depicted are for illustrative purposes only and is not meant to limit the methods 100, 200 in any way as it is understood that the portions of the method can proceed in a different logical order, additional or intervening portions can be included, or described portions of the method can be divided into multiple portions, or described portions of the methods can be omitted without detracting from the described method. For example, the methods 100, 200 can include various other intervening steps. The examples provided herein are meant to be non-limiting.

It is contemplated that aspects of this disclosure can be advantageous for use over conventional systems or methods for updating the flight plan of the aircraft. Aspects of this disclosure reduce workload of pilot checking flight plan updates that can be keyed-in manually or provided via external source (e.g. ACARS). This is particularly advantageous in the case of Single Pilot Operations (SPO) or Reduced Crew Operations (RCO).

It is further contemplated that aspects of this disclosure can advantageously reduce errors associated with changes or updates to flight plans, thereby reducing the number of flight diversions, the number of warnings due to erroneous flight plans. Mandatory reporting and investigations can likewise be advantageously reduced. It is further contemplated that aspects of this disclosure can increase aviation security by including a plausibility check of received updates to flight plans.

For example, advantages can include more frequent or constant updates to the flight plan of an aircraft and also allows for the flight crew or the pilot for more freedom of time when compared to conventional updating methods (e.g., the flight crew or the pilot is not to be bogged down with updating the flight plan manually). It will be appreciated that this freedom of time can be of particular advantage when flying with SPO or RCO.

Additionally, safety issues can be identified well in advance of warnings that would be provided by a TAWS or EGPWS. This not only enhances safety but further provides additional time to determine alternative flight parameters to avoid the safety issue altogether. For example, conventional updating methods can require that the pilot or the flight crew manually perform the updating of the flight plan. Specifically, conventional updating methods can require the pilot or the flight crew manually accept the update to the flight plan, manually authenticate the flight plan, and then manually update the flight plan. This can be very time consuming and take the flight crew or the pilot away from other tasks that need to be performed to operate the aircraft. Due to the time demand it takes to update the flight plan with conventional updating methods, the time between updates to the flight plan can be larger to ensure the pilot and the flight crew are not bogged down by having to constantly manually update the flight plan. The method disclosed herein, however, does not require intensive manual interactions from the flight crew or the pilot, nor reliance on an EGPWS. In fact, the methods described herein can in some instances not require any interaction from the flight crew or the pilot at all, while still ensuring safe flight.

To the extent not already described, the different features and structures of the various embodiments can be used in combination with each other as desired. That one feature is not illustrated in all of the embodiments is not meant to be construed that it may not be included, but is done for brevity of description. Thus, the various features of the different embodiments may be mixed and matched as desired to form new embodiments, whether or not the new embodiments are expressly described. All combinations or permutations of features described herein are covered by this disclosure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Various characteristics, aspects and advantages of the present disclosure may also be embodied in any permutation of aspects of the disclosure, including but not limited to the following technical solutions as defined in the enumerated aspects:

A method for updating a first flight plan having a first set of flight parameters, for an aircraft, comprising: receiving, via an avionics device, a change to the first flight plan; determining a second set of flight parameters based on the change to the first flight plan; receiving at least one of terrain data and SUA data, NOTAM data, SIGMET data, and PIREP data; and performing a safety validation of the second set of flight parameters, wherein the safety validation comprises: comparing the second set of flight parameters with the received at least one of terrain data and SUA data, NOTAM data, SIGMET data, and PIREP data; determining, based on the comparison, whether the second set of flight parameters plan presents a risk to safe flight.

The method of the preceding clause, further comprising in the event it is determined that the second set of flight parameters presents a risk to safe flight, generating, via the avionics device a first signal indicative of the risk.

The method of any preceding clause, further comprising in the event it is determined that the second set of flight parameters does not present a risk to safe flight, automatically generating, via the avionics device, a second flight plan comprising the second set of flight parameters.

The method of any preceding clause, further comprising generating, via the avionics device a second signal indicative of the determination that the second set of flight parameters does not present a risk to safe flight.

The method of any preceding clause, further comprising requesting, with the avionics device, a third set of flight parameters.

The method of any preceding clause, wherein requesting the third set of flight parameters includes identifying at least one safety issue based on second set of flight parameters.

The method of any preceding clause, further comprising receiving with the avionics device, the third set of flight parameters.

The method of any preceding clause, further comprising performing, with the avionics device, the safety validation of the third set of flight parameters.

The method of any preceding clause, further including revising with the avionics device, the second set of flight parameters to define a third flight plan comprising the third set of flight parameters.

The method of any preceding clause, further comprising displaying on a device in the aircraft a difference between the first set of flight parameters and the second set of flight parameters.

The method of any preceding clause, wherein the terrain data is received from a database on board the aircraft.

The method of any preceding clause, wherein the risk to safe flight is a risk of unintentional terrain incursion.

The method of any preceding clause, wherein the risk to safe flight is a risk of unintentional entry by the aircraft into a no-fly zone.

The method of any preceding clause, wherein the risk to safe flight is a risk of flight into hazardous weather conditions.

The method of any preceding clause, wherein the change to the first flight plan is received from source external to the aircraft.

The method of any preceding clause, further comprising writing to a memory of the avionics device a log entry comprising data associated with predetermined data fields corresponding to the first set of flight parameters and the second set of flight parameters.

The method of any preceding clause, further including at least one of authenticating or validating, via the avionics device, the received change to the first flight plan to define a valid update.

A system for an aircraft, comprising: an avionics device adapted to verify an updated flight plan, and to perform the steps of: receiving, a change to the first flight plan, the change to the first flight plan comprising a second set of flight parameters; receiving at least one of terrain data, special use airspace (SUA) data, NOTAM data, SIGMET data, and PIREP data; and performing a safety validation of the second set of flight parameters, wherein the safety validation comprises: comparing the second set of flight parameters with the received at least one of terrain data and SUA data; determining, based on the comparison, whether the second set of flight parameters plan presents a risk to safe flight.

The system of the preceding clause, wherein in the event it is determined that the second set of flight parameters presents a risk to safe flight, the avionics device is further adapted to perform the step of generating a first signal indicative of the risk.

The system of any preceding clause, wherein when in the event it is determined that the second set of flight parameters does not present a risk to safe flight, the avionics device is further adapted to automatically generate a second flight plan comprising the second set of flight parameters.

What is claimed is:

1. A method for updating a first flight plan having a first set of flight parameters, for an aircraft, comprising:

receiving, via an avionics device, a change to the first flight plan;

determining a second set of flight parameters based on the change to the first flight plan;

receiving at least one of terrain data, Special Use Airspace (SUA) data, Notice To Airmen (NOTAM) data, Significant Meteorological Information (SIGMET) data, and Pilot Report (PIREP) data; and performing a safety validation of the second set of flight parameters, wherein the safety validation comprises:

comparing the second set of flight parameters with the at least one of terrain data, SUA data, NOTAM data, SIGMET data, and PIREP data; and determining, based on the comparison, whether the second set of flight parameters presents a risk to safe flight; wherein in the event of a determination that the second set of flight parameters does not present a risk to safe flight, operating the aircraft in accordance with the second set of flight parameters; and in the event of a determination that the second set of flight parameters presents a risk to safe flight, requesting, with the avionics device, a third set of flight parameters; and automatically creating an error report, including the data associated with predetermined data fields corresponding to the first set of flight parameters and the second set of flight parameters.

2. The method of claim 1, further comprising, in the event of the determination that the second set of flight parameters presents a risk to safe flight, generating, via the avionics device, a first signal indicative of the risk.

3. The method of claim 1, further comprising, in the event of the determination that the second set of flight parameters does not present a risk to safe flight, generating, via the avionics device, a second flight plan comprising the second set of flight parameters.

4. The method of claim 3, further comprising generating, via the avionics device a second signal indicative of the determination that the second set of flight parameters does not present a risk to safe flight.

5. The method of claim 2, wherein requesting the third set of flight parameters includes identifying at least one safety issue based on the second set of flight parameters.

6. The method of claim 2, further comprising receiving with the avionics device, the third set of flight parameters.

7. The method of claim 6, further comprising performing, with the avionics device, the safety validation of the third set of flight parameters.

8. The method of claim 7, further including revising with the avionics device, the second set of flight parameters to define a third flight plan comprising the third set of flight parameters.

9. The method of claim 1, further comprising displaying on a device in the aircraft a difference between the first set of flight parameters and the second set of flight parameters.

10. The method of claim 1, wherein the terrain data is received by the avionics device from a database on board the aircraft.

11. The method of claim 1, wherein the risk to safe flight is a risk of unintentional entry by the aircraft into a no-fly zone.

12. The method of claim 1, wherein the change to the first flight plan is received from source external to the aircraft.

13. The method of claim 1, further comprising writing to a memory of the avionics device a log entry comprising data associated with predetermined data fields corresponding to the third set of flight parameters.

14. The method of claim 1 further including at least one of authenticating or validating, via the avionics device, the received change to the first flight plan to define a valid update.

15. The method of claim 1, further comprising saving the error report to a flight data recorder.

16. A system for an aircraft, comprising:

an avionics device adapted to verify an updated flight plan, and to perform the steps of:

receiving, a change to a first flight plan having a first set of flight parameters, the change to the first flight plan comprising a second set of flight parameters;

receiving at least one of terrain data, SUA data, NOTAM data, SIGMET data, and PIREP data; and performing a safety validation of the second set of flight parameters, wherein the safety validation comprises:

comparing the second set of flight parameters with the received at least one of terrain data, SUA data, NOTAM data, SIGMET data, and PIREP data; and determining, based on the comparison, whether the second set of flight parameters plan presents a risk to safe flight; wherein in the event of a determination the second set of flight parameters does not present a risk to safe flight, operating the aircraft in accordance with the second set of flight parameters; and in the event of a determination that the second set of flight parameters presents a risk to safe flight, requesting, with the avionics device, a third set of flight parameters; and automatically creating an error report, including the data associated with predetermined data fields corresponding to the first set of flight parameters and the second set of flight parameters.

17. The system of claim 16, wherein in the event of the determination that the second set of flight parameters presents a risk to safe flight, the avionics device is further adapted to perform the step of generating a first signal indicative of the risk.

18. The method of claim 16, wherein when in the event of the determination that the second set of flight parameters does not present a risk to safe flight, further comprising generating with the avionics device a second flight plan comprising the second set of flight parameters.

19. The method of claim 15 further comprising designating protecting at least a portion of the error report from overwriting.

* * * * *